US005732896A

United States Patent [19]

Jakob et al.

[11] Patent Number: 5,732,896

[45] Date of Patent: Mar. 31, 1998

[54] ANTI-SPIN MECHANISM FOR GYRATORY CRUSHER

[75] Inventors: Herbert E. Jakob, Chattanooga, Tenn.; James C. Bremer, Slinger, Wis.

[73] Assignee: Astec Industries, Inc., Chattanooga, Tenn.

[21] Appl. No.: 634,647

[22] Filed: Apr. 18, 1996

[51] Int. Cl.[6] ..... B02C 2/04

[52] U.S. Cl. ..... 241/215

[58] Field of Search ..... 241/207–216, 241/202, 264, 265, 101.2

[56] References Cited

U.S. PATENT DOCUMENTS

| | | |
|---|---|---|
| 1,523,674 | 1/1925 | Torrance . |
| 1,641,776 | 9/1927 | Newhouse . |
| 3,207,449 | 9/1965 | Johnson . |
| 3,743,193 | 7/1973 | DeDiemar et al. . |
| 3,750,809 | 8/1973 | DeDiemar et al. . |
| 4,037,800 | 7/1977 | Coxhill . |
| 4,206,881 | 6/1980 | Werginz . |
| 4,467,971 | 8/1984 | Schuman . |
| 4,666,092 | 5/1987 | Bremer . |
| 4,779,808 | 10/1988 | Graf . |

OTHER PUBLICATIONS

AAC Manual 4020, American Autogard Corp., *Installation and Maintenance Manual, Autogard Torque Limiter 400 Series*, pp. 1–8.

*Primary Examiner*—Mark Rosenbaum
*Attorney, Agent, or Firm*—Nilles & Nilles, S.C.

[57] ABSTRACT

A gyratory crusher includes an anti-spin mechanism which couples a lower end of the eccentric shaft of the crusher to the stationary frame of the crusher so as to prevent the eccentric shaft and associated crushing head from spinning when the crusher is not subject to a crushing load. The anti-spin mechanism includes 1) a gear train preferably formed from two sets of intermeshing gears, and 2) a torque limiter which is coupled to the gear train and which releases upon the imposition of a crushing load on the crusher so as to permit relatively slow rotation of the eccentric and crushing head counter to the direction of rotation of the main drive gear or bull gear.

9 Claims, 2 Drawing Sheets

ANTI-SPIN MECHANISM FOR GYRATORY CRUSHER

BACKGROUND OF THE INVENTION

1. Field of the Invention

The invention relates to gyratory crushers and, more particularly, to gyratory crushers of the type having a crushing head mounted on an eccentric shaft and incorporating a mechanism to prevent the eccentric shaft and crushing head from spinning in the absence of a crushing load.

2. Discussion of the Related Art

Gyratory or cone crushers (sometimes known as gyrasphere crushers) are well known for crushing stone. A typical gyratory crusher includes 1) a stationary frame, 2) a generally conical crushing head mounted for rotation about an eccentric shaft and including an upwardly facing convex crushing surface, and 3) an annular crusher bowl or concave that is mounted in the frame above the crushing head so as to define a crushing gap forming an annular crushing chamber. Eccentric rotation of the shaft is effected by rotatably mounting the shaft on the crusher's main drive gear or bull gear on an axis which is offset from and inclined with respect to the axis of rotation of the main drive gear.

During a crushing operation, the crushing head, through the material being crushed, is placed in rolling engagement with the concave or crusher bowl and thus rotates, relative to the stationary frame and the main drive gear, in a direction opposite to the direction of main drive gear rotation. The crushing head and eccentric shaft are mounted so as to be freely rotatable within the main drive gear to accommodate such relative rotation. However, in the absence of a crushing load, the crushing head tends to rotate in the same direction and at the same speed as the main drive gear. When material to be crushed is fed into the crushing cavity and contacts the freely spinning crushing head, the material detrimentally abrades the crushing head and also the concave, both of which are typically formed from a relatively soft manganese liner. Initial contact between the stone or other materials to be crushed and the freely spinning head also can result in ejection of small and even some relatively large stones from the crusher, risking damage to external components of the crusher or injury to personnel in the vicinity of the crusher.

Many so-called "anti-spin" mechanisms have been proposed to eliminate or at least inhibit free spinning of an unloaded crushing head. Examples of such anti-spin mechanism are disclosed in U.S. Pat. No. 3,743,193 to DeDiemar et al.; U.S. Pat. No. 3,750,809 to DeDiemar et al.; U.S. Pat. No. 4,206,881 to Werginz; U.S. Pat. No. 4,467,971 to Schuman; and U.S. Pat. No. 4,666,092 to Bremer. All of these patents disclose anti-spin mechanisms employing hydraulic brakes or some other device located near the upper end of the eccentric shaft, i.e., within the crushing head, to resist or prevent crushing head spinning. The anti-spin mechanisms disclosed in all of these patents therefore are incompatible or at least ill-suited for use with a solid eccentric shaft or one lacking a large internal axial bore.

Apart from problems of complexity and incompatibility with many eccentric shafts, another problem associated with many of the anti-spin mechanisms disclosed by the patents listed above is that the length of the eccentric shaft and associated drive elements must be increased substantially to accommodate the anti-spin mechanism, leading to a significant increase in the overall axial height of the crusher. This represents a problem because crushers form but one component of a quarry system and must be sized to be compatible with augers, elevators, and conveyors commonly employed in quarry systems.

Still another problem associated with the anti-spin mechanisms disclosed in many of the patents listed above is that they are not very robust and cannot survive the severe vibrations and shock loads imposed on the mechanisms during crushing for prolonged periods of time. Moreover, many of these mechanisms are relatively inaccessible and difficult to install initially and to replace when they fail.

Yet another problem associated with many heretofore available anti-spin mechanisms is that they can never permit rotation of the eccentric shaft and crushing head in the same direction that the main drive or bull gear rotates. Accordingly, if the crushing head becomes jammed due, e.g, to the introduction of non-crushable materials (known as tramp) into the crusher, the anti-spin mechanism and/or other components of the crusher are destroyed.

OBJECTS AND SUMMARY OF THE INVENTION

It is therefor a primary object of the invention to provide an anti-spin mechanism which prevents undesired free spinning of the crushing head and eccentric shaft of an unloaded gyratory crusher and which requires minimal modifications to crusher design for its implementation.

Another object of the invention is to provide an anti-spin mechanism which has the characteristics discussed above and which is relatively robust.

Still another object of the invention is to provide an anti-spin mechanism which exhibits one or more of the characteristics discussed above and which is relatively easy to install and replace.

In accordance with a first aspect of the invention, these objects are achieved by providing a gyratory crusher comprising a stationary frame, a main drive gear which is mounted on the frame and which is driven to rotate about a vertical axis, an eccentric shaft rotatably supported on the main drive gear at a location which is offset from the vertical axis, the eccentric shaft having an upper portion and having a lower portion, a crushing head mounted on the upper portion of the eccentric shaft, and an anti-spin mechanism. The anti-spin mechanism includes a torque limiter located in the vicinity of the lower portion of the eccentric shaft, and a gear train operatively coupled to the lower portion of the eccentric shaft and to the torque limiter.

Preferably, the gear train comprises an idler shaft and first through fourth gears. The first gear is located above an upper surface of the main drive gear and is fixed to the lower portion of the eccentric shaft. The idler shaft is rotatably journaled in the main drive gear at a location offset from the central axis. The idler shaft has an upper end located above the upper surface of the main drive gear and a second end located below a lower surface of the main drive gear. The second gear is fixedly mounted on the upper end of the idler shaft and meshes with the first gear. The first and second gears have a gear ratio of 1:1. The third gear is fixedly mounted on the lower end of the idler shaft. A torque limiter shaft is affixed to the torque limiter and has an upper end located above the torque limiter. The fourth gear is affixed to the upper end of the torque limiter shaft and meshes with the third gear. The third and fourth gears have a gear ratio of 1:1.

Preferably, the torque limiter comprises a clutch including a first, stationary member which is fixed to the stationary frame, a second member which is located adjacent to the first member and which has a bore formed therethrough which non-rotatably receives the torque limiter shaft, and means for preventing rotation of the second member relative to the first member unless a torque imposed on the second member by the torque limiter shaft exceeds a designated threshold. The means for preventing preferably comprises 1) a slide plate which selectively meshes with the second member, 2) a ball and ramp assembly disposed between the first member and the slide plate and 3) a belleville washer assembly which biases the slide plate towards the first member.

Yet another object of the invention is to provide an anti-spin mechanism which has one or more of the characteristics described above and which will not fail if the crusher becomes temporarily jammed due, e.g, to the introduction of tramp into the crusher.

In accordance with another object of the invention, this object is achieved by employing a two-way clutch in the torque limiter.

Still another object of the invention is to provide an improved method of preventing the crushing head and associated eccentric shaft of a gyratory crusher from spinning freely in the direction of main drive gear rotation in the absence of a crushing load while permitting relatively slow rotation of the crushing head and eccentric shaft in the opposite direction as the main drive gear during crushing.

In accordance with another aspect of the invention, this object is achieved by first providing a gyratory crusher including a stationary frame, a main drive gear rotatably mounted on the frame, an eccentric shaft which is mounted on the main drive gear so as to be rotatable about an axis which is offset from a central axis of the drive gear, and a gear train coupled to a lower end of the eccentric shaft. Subsequent steps include driving the drive gear to rotate at a first speed in a first rotational direction, rotatably coupling the gear train to the stationary frame when the crusher is not subject to a load such that the eccentric shaft does not rotate about its axis, and decoupling the gear train from the stationary frame upon the application of a designated load to the crushing head, thereby permitting the eccentric shaft to rotate about its axis in a second direction opposite the first direction.

Yet another object of the invention is to provide a method which exhibits one or more of the characteristics described above and which permits rotation of the crushing head and eccentric shaft in the same direction as the main drive gear if tramp is jammed in the crushing cavity.

In accordance with another aspect is achieved, this object is achieved by selectively decoupling the gear train from the stationary frame so as to permit the eccentric shaft to rotate about its axis in the first direction.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Resume

Pursuant to the invention, a gyratory crusher is provided having an anti-spin mechanism which couples a lower end of the eccentric shaft of the crusher to the stationary frame of the crusher so as to prevent the eccentric shaft and associated crushing head from spinning when the crusher is not subject to a crushing load. The anti-spin mechanism includes 1) a gear train preferably formed from two sets of intermeshing gears, and 2) a torque limiter which is coupled to the gear train and which releases upon the imposition of a crushing load on the crusher so as to permit relatively slow rotation of the eccentric and crushing head counter to the direction of rotation of the main drive gear or bull gear.

2. System Overview and Construction of Anti-Spin Mechanism

Figure 1:
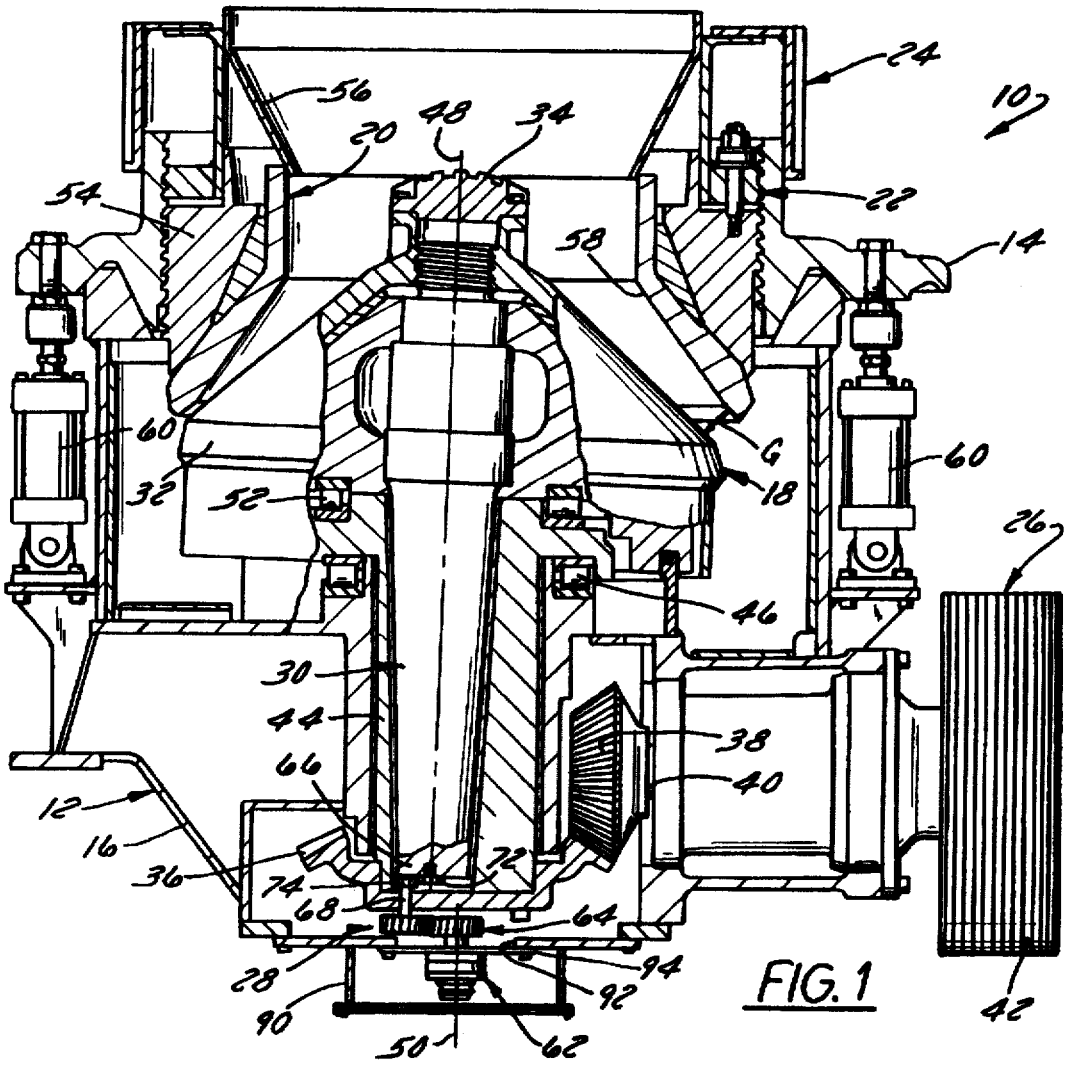
FIG. 1 is a sectional side elevation view of a gyratory crusher constructed in accordance with a preferred embodiment of the invention.

Referring now to the drawings and to FIG. 1 in particular, a gyratory or cone crusher 10 (sometimes known as a gyrasphere crusher) is illustrated. Crusher 10 includes a main crusher frame 12 having upper and lower portions 14 and 16, a crushing head 18 mounted on the crusher frame lower portion 16, and a crusher bowl 20 mounted on the crusher frame upper portion 14 above the crushing head 18. The crusher bowl 20 is normally held fast from rotation with respect to the crusher frame upper portion 14 by a bowl lock assembly 22, but the bowl lock assembly 22 is selectively releasable to permit vertical adjustment of the bowl 20 relative to the head 18 using a bowl adjuster mechanism 24. Rotation of the crushing head 18 is controlled by a drive mechanism 26 and by an inventive anti-spin mechanism 28.

The crushing head 18 is fixedly mounted on the upper end 34 of an eccentric shaft 30 and is generally frusto-conical in shape. The outer, crushing portion or mantle of the crushing head is formed from a replaceable manganese liner 32 threaded onto the upper end 34 of the eccentric shaft 30 as illustrated in FIG. 1. The eccentric shaft 30 is mounted on a main drive or bull gear 36 comprising a bevel gear driven by the drive mechanism 26. The drive mechanism 26 comprises 1) a spur gear 38 meshing with the main drive gear 36, 2) a horizontal input shaft or countershaft 40 journaled in the crusher frame lower portion 16 and connected at its inner end to the gear 38, and 3) a sheave 42 mounted on the outer end of the countershaft 40 and driven in a conventional manner.

A generally tubular support member 44 is fixed to the main drive gear 36 and extends upwardly therefrom so as to be rotatably journaled in the crusher frame lower portion 16 by bearings 46. The eccentric shaft 30 extends through the tubular support member 44 on an axis 48 which is offset from and inclined with respect to the axis of rotation 50 of the main drive gear 36. The crushing head 18 and thus the shaft 30 are rotatably supported on the tubular support member 44 by upper bearings 52. The eccentric shaft 30 is of a type which is either solid or has only relatively small lubrication bores formed axially therethrough for the purpose of permitting limiting flow of lubricating fluid to the bearings 46, 52. It is important to note that this and similar eccentric shafts cannot support hydraulic brakes or other anti-spin mechanisms at their upper ends.

The crusher bowl 20 includes a body or frame 54, an upper uncrushed and/or pre-crushed rock feed hopper 56, and a lower concave surface 58 (often referred to as "a concave") which is formed from a replaceable manganese liner. Concave surface 58 surrounds the manganese liner 32 forming the convex crushing surface of the crushing head 18 and is spaced above it to define a crushing gap G having a thickness which varies around the circumference of the crushing head 18 due to the eccentric mounting of the eccentric shaft 30 and the crushing head 18 on the main drive gear 36. In order to permit vertical adjustment of the crusher bowl 20 relative to the crusher frame 12 and thus to permit adjustment of the thickness of the gap G, a helically threaded connection is provided between the crusher bowl 20 and the frame upper portion 14 to permit vertical adjustment of the bowl 20 relative to the frame upper portion 14. The bowl 20 is normally locked from rotation with respect to the frame upper portion 14 by the bowl lock assembly 22, but the bowl lock assembly 22 can be selectively released to permit rotation of the crusher bowl 20 relative to the frame 12 for gap adjustment purposes, under the action of the adjuster mechanism 24, in a manner which is, per se, well known. The crusher frame upper portion 14 is connected to the crusher frame lower portion 16 by a plurality of tramp relief cylinders 60 which can be selectively actuated to lift the crusher frame upper portion 14 for tramp relief purposes in a conventional manner.

3. Construction of Anti-Spin Mechanism

The gyratory or cone crusher 10 as thus far described (save for the brief description of the anti-spin mechanism 28) would operate acceptably except for the fact that the crushing head 18 and eccentric shaft 30 would spin in the absence of a crushing load due to the fact that the eccentric shaft 30 is rotatably journaled in the main drive or bull gear 36 and due to the fact that the main drive gear 36 rotates at a relatively high rate, typically about 300–400 rpm. Crushing head spinning is undesirable because, upon initiation of a crushing action, contact between the stone and the rapidly spinning crushing head 18 would rapidly abrade and prematurely wear the manganese liner 32. Moreover, contact between the stones and the rapidly spinning crushing head 18 could cause at least some of the stones to be thrown out of the crusher 10 and the risk of damage to the crusher 10 or possible injury to personnel in the surrounding area. Crushing head spinning also would tend to channel rocks towards the widest point of the crushing gap G and cause many smaller stones to fall through the crushing chamber without being crushed. It is for these reasons that an anti-spin mechanism is desirable and that the inventive anti-spin mechanism 28 is provided.

The inventive anti-spin mechanism 28 is designed to prevent undesired crushing head spinning in the absence of a crushing load by rotatably coupling the eccentric shaft 30 to the stationary frame 12 at least in the absence of a crushing load. The inventive anti-spin mechanism 28 is also designed to achieve this goal simply and inexpensively while cooperating only with the lower portion of the eccentric shaft 30.

Figure 3:
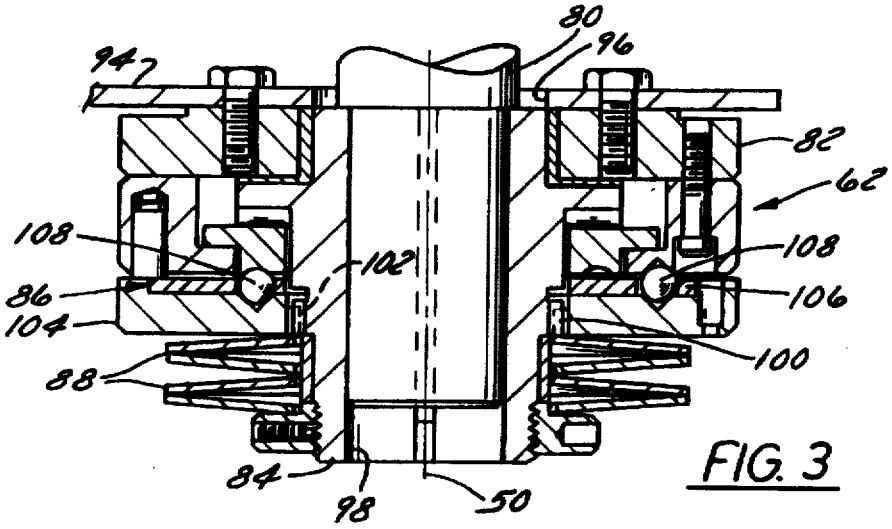
FIG. 3 is a sectional elevation view of a torque limiter of the gear train the anti-spin mechanism of FIGS. 1 and 2.
Figure 4:
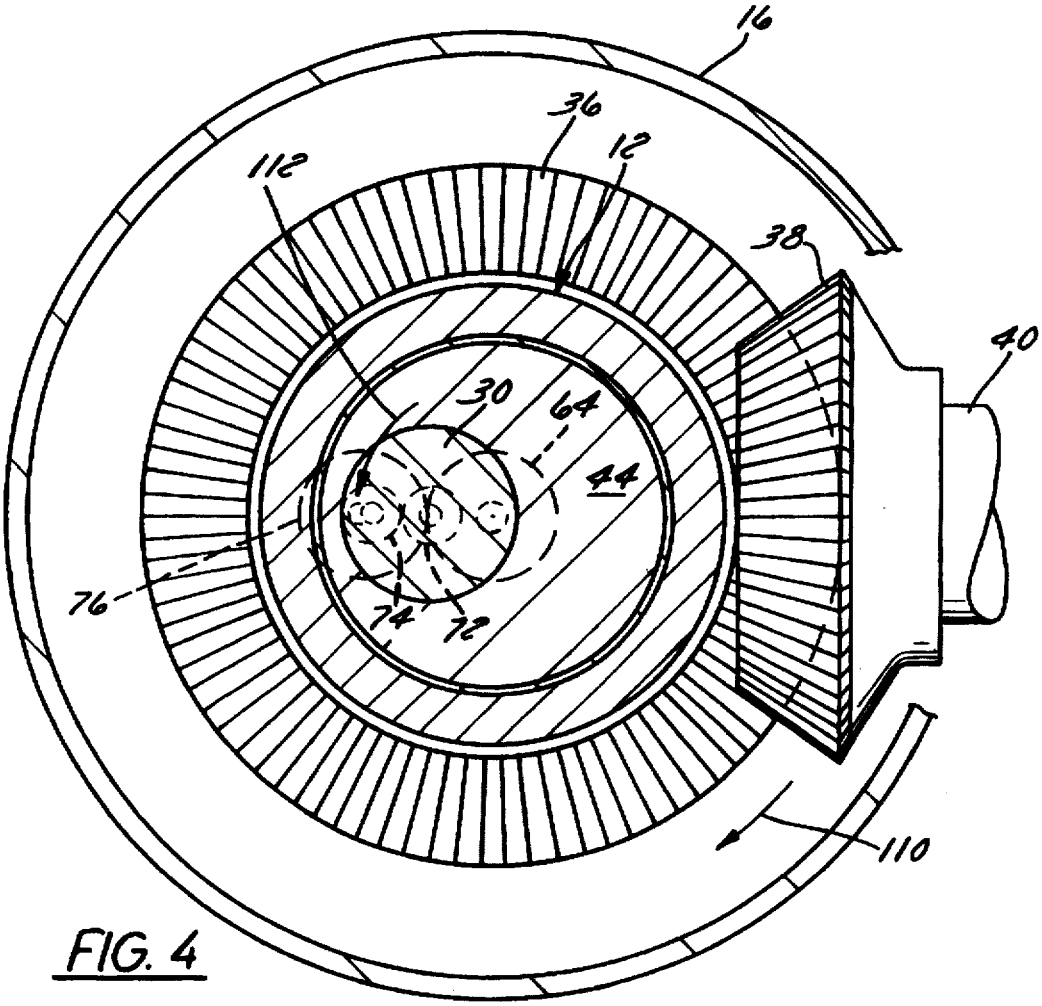
FIG. 4 is a sectional plan view taken along the lines 4—4 in FIG. 2.
Figure 2:
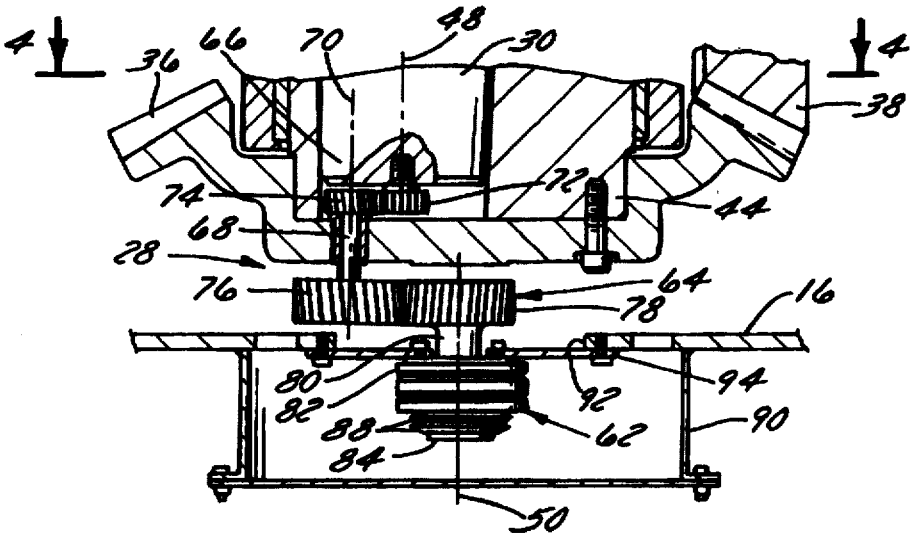
FIG. 2 is an enlarged sectional view of a portion of the crusher of FIG. 1 and illustrating a gear train of the anti-spin mechanism of the crusher.

Towards these ends, referring particularly to FIGS. 2–4, the anti-spin mechanism 28 includes 1) a torque limiter 62 located in the vicinity of the lower portion 66 of the eccentric shaft 30 and 2) a gear train 64 operatively coupled to the lower portion 66 of the eccentric shaft 30 and to the torque limiter 62.

Although various gear trains could be employed in the anti-spin mechanism 28, the preferred gear train 62 employs an idler shaft 68 which is rotatably journaled to the main drive gear 36 at a location offset from the drive gear central axis 50 so as to revolve around the axis 50 and to rotate about its own axis 70 upon rotation of the main drive gear 36. Gears located above and below the main drive gear 36 form a quasi-planetary gear system coupling the idler shaft 68 to the torque limiter 62. In the preferred and illustrated embodiment, these gears comprise first and second gear sets provided at opposite ends of the idler shaft 68 so as to be located above and below the main drive gear 36. Specifically, referring to FIGS. 2 and 4, a first gear 72 is located above the upper surface of the main drive gear 36, is coaxial with the eccentric shaft 30, and is threaded or otherwise fixed to the lower portion 66 of the eccentric shaft 30 so as to rotate about the axis 48 when the eccentric shaft 30 rotates. A second gear 74 is fixedly mounted on the upper end of the idler shaft 68 and meshes with the first gear 72. The first and second gears 72 and 74 have a gear ratio of 1:1. A third gear 76 is fixedly mounted on the lower end of the idler shaft 68, and a fourth gear 78 is affixed to the upper end of a torque limiter shaft 80 so as to mesh with the third gear 76. The third and fourth gears 76 and 78 have a gear ratio of 1:1.

It is currently contemplated that all of the gears 72, 74, 76, and 78 will be spur gears because spur gears are relatively simple and inexpensive to manufacture and because spur gears can tolerate some axial misalignment. Such tolerance is required because the idler shaft 68 and third gear 76, rotating about an axis 70 which is parallel with the axis 48 of the eccentric shaft 30, are inclined with respect to the fourth gear 78 and the torque limiter shaft 80 which extend coaxially with the axis 50 of the main drive gear 36. It may be desirable or even required in some instances, depending upon the angle of inclination of the idler shaft 68 and third gear 76 relative to the torque limiter shaft 80 and fourth gear 78, to employ helical teeth or some other more exotic teeth on the third and/or fourth gears 76 and 78 which can accommodate such inclination.

The torque limiter 62 is designed to prevent the fourth gear 78 from rotating in the absence of a crushing load on the crusher 10 and to permit at least unidirectional, and preferably hi-directional, rotation of the fourth gear 78 under other circumstances. A torque limiter in the form of the illustrated bi-directional clutch is well suited for this purpose. The illustrated torque limiter 62 incorporating a bi-directional clutch is, per se, conventional and is available from American AutoGard Corporation of Rockford, Ill. under the Model No. 403. Referring to FIGS. 2 and 3, the torque limiter 62 comprises a stationary first member 82, a second member 84, and a ball and ramp assembly 86 and a spring assembly 88 which, in combination, selectively 1) lock the second member 84 to the first member 82 to prevent rotation of the second member 84 and torque limiter shaft 80 relative to the first member 82 and stationary frame 12, and 2) permit rotation of the second member 84 and torque limiter shaft 80 relative to the first member 82 and stationary frame 12. The entire torque limiter 62 is disposed in an oil reservoir 90 mounted beneath a central aperture 92 formed in the crusher frame lower portion 16. Oil in the reservoir 90 provides lubrication for the torque limiter 62, gear train 64, and other components of the crusher 10.

Referring especially to FIG. 3, the first member 82 comprises a stationary ring which is bolted to a metal plate 94. The plate 94 1) has a central aperture 96 which receives the shaft 80 and 2) is bolted at its ends to the stationary frame lower portion 16. The second member 84 comprises a hub having an internal axial bore 98 to which is keyed the torque limiter shaft 80. The hub 84 has external teeth 100 which selectively mesh with internal teeth 102 on an annular slide plate 104. The ball and ramp assembly 86, formed from a cage plate 106 and a plurality of balls 108, is disposed axially between the slide plate 104 and the stationary ring 82. The springs urge the slide plate 104 against the cage plate 106 and balls 108. The springs of the assembly 88 preferably comprise belleville washers as illustrated but which could comprise helical compression or other springs.

In use, the spring assembly 88 and ball and ramp assembly 86 maintain the slide plate 104 in a position in which it meshes with the hub 84 to lock the hub 84 to the stationary ring 82 so long as torque imposed on the hub 84 by the torque limiter shaft 80 does not exceed a designated threshold—1500 lbf. in. in the illustrated embodiment. Once this torque threshold is surpassed in either direction, the slide plate 104 rotates so as to ride up the ball and ramp assembly 86 and out of engagement with the teeth 100 on the hub 84, thereby permitting the hub 84 and torque liter shaft 80 to spin freely with respect to the stationary ring 82.

4. Operation of Anti-Spin Mechanism

In operation, the main drive or bull gear 36 is driven by the sheave 42, countershaft 40, and gear 38 to rotate clockwise (in the direction of arrow 110 in FIG. 4) at a designated speed, typically about 350 rpm. The torque limiter 62 locks the torque limiter shaft 80 and fourth gear 78 from rotation so long as the crusher 10 remains unloaded. The gears 74 and 76 therefore revolve around the gears 72 and 78 without rotation of either the gear 72 or the gear 78. Accordingly, even though the main drive gear 36 is turning at a relatively high rate about its axis 50, the crushing head 18 and eccentric shaft 30 do not rotate about their axis 48. They merely revolve eccentrically about the axis 50.

When stones are fed into the crusher 10 to initiate a crushing operation, contact between the stones and the clockwise-revolving crushing head 18 imparts a counterclockwise torque to the crushing head 18 and eccentric shaft 30. This counterclockwise torque is transmitted to the torque limiter 62 through the gears 72, 74, 76, and 78. When the amount of counterclockwise torque exceeds the rated release value of the torque limiter 62, 1500 lbf. in. in the illustrated embodiment, the gear 78 and torque limiter shaft 80 will begin to turn. The torque limiter 62 disengages after about 10° to 15° of torque limiter shaft rotation thereby to decouple the gear train 64 from the frame 12 to permit free spinning of the entire gear train 64. The crushing head 18 and eccentric shaft 30 are now free to rotate counterclockwise (in the direction of arrow 112 in FIG. 4) at a relatively slow speed, usually about 5% of the speed of the main drive gear 36 or about 17 rpm when the main drive gear 36 is rotating at 350 rpm. This relatively slow counterclockwise rotation is desirable not only to prevent uneven wear on the manganese liner 32, but also to prevent stones from channeling directly to the widest point of the crushing gap G.

When crushing ceases, the crushing head 18 will slow and stop, and then begin to rotate in a clockwise direction. However, the torque limiter 62 will reengage after only 10° to 15° of torque limiter shaft rotation to again prevent the torque limiter shaft 80 and gear 78 from rotating and thereby to prevent clockwise rotation of the crushing head 18.

If a piece of non-crushable material, known as tramp, becomes lodged between the crushing head 18 and the concave surface 58 during crushing, the crushing head 18 will be forced to rotate clockwise until the tramp release cylinders 60 can open the crusher 10 to permit the tramp to fall out of the crushing chamber. If a unidirectional torque limiter were to be used for the torque limiter 62, this clockwise rotation would destroy the torque limiter 62 and/or other components of the anti-spin mechanism 28. It is for this reason that a bi-directional clutch is used in the torque limiter 62 so that the torque limiter releases 62 to permit clockwise rotation of the crushing head 18 when the crushing head 18 imposes a torque on the torque limiter 62 above that which would normally be imposed when the crusher 10 is not loaded.

The inventive anti-spin mechanism 28 exhibits many advantages over previously known anti-spin mechanisms.

By permitting limited counterclockwise crushing head rotation, the anti-spin mechanism 28 reduces manganese wear, reduces shock loads on the crusher 10, prevents stones from being thrown from the crusher 10, and allows the bearing assembly 46 to remain in continual rotation during crushing.

The anti-spin mechanism 28 is useable with a solid or a nearly solid one piece eccentric shaft 30 because it cooperates only with the lower portion 66 of the shaft 30. It is also easily accessible because it is located beneath all major components of the crusher 10. This accessibility facilitates both new and retrofit installation and also facilitates replacement. Moreover, because it is relatively compact and can be used with an eccentric shaft of standard length, the anti-spin mechanism 28 does not increase the overall height of the crusher 10.

The torque limiter 62, though relatively sturdy, serves as the weak point of the crusher's drive mechanism 26 and anti-spin mechanism 28. The torque limiter 62 therefore will fail in the presence of excessive damaging loads before the other components of the crusher 10. This early failure is desirable because the torque limiter 62 is easy to access and replace when compared to the other components of the crusher 10. The use of the bi-directional clutch in the torque limiter 62 inhibits damage to the anti-spin mechanism 28 in the presence of excessive clockwise torques imposed on the anti-spin mechanism 28 by the eccentric shaft 30, occurring, e.g, when tramp is lodged in the crushing chamber.

Many changes and modifications could be made to present invention without departing from the spirit thereof. The scope of these changes will become apparent from the appended claims.

I claim:

1. A gyratory crusher comprising:

(A) a stationary frame;

(B) a main drive gear which is mounted on said frame and which is driven to rotate about a vertical axis;

(C) an eccentric shaft rotatably supported on said main drive gear at a location which is offset from said vertical axis, said eccentric shaft having an upper portion and having a lower portion;

(D) a crushing head mounted on said upper portion of said eccentric shaft; and (E) an anti-spin mechanism comprising (1) a torque limiter located in the vicinity of said lower portion of said eccentric shaft, and (2) a gear train operatively coupled to said lower portion of said eccentric shaft and to said torque limiter.

2. A crusher as defined in claim 1, wherein said gear train comprises a first gear which is located above an upper surface of said main drive gear and which is fixed to said lower portion of said eccentric shaft, an idler shaft which is rotatably journaled in said main drive gear at a location offset from said vertical axis, a second gear which is fixedly mounted on said idler shaft and which meshes with said first gear, and a third gear which is fixedly mounted on said idler shaft and which is operatively coupled to said torque limiter.

3. A crusher as defined in claim 2, wherein said gear train further comprises a torque limiter shaft which is affixed to said torque limiter and a fourth gear which is affixed to said torque limiter shaft and which meshes with said third gear.

4. A crusher as defined in claim 3, wherein said first and second gears have a gear ratio of 1:1 and said third and fourth gears have a gear ratio of 1:1.

5. A crusher as defined in claim 1, wherein said gear train comprises a torque limiter shaft affixed to said torque limiter, and wherein said torque limiter comprises a clutch, said clutch including a first, stationary member which is fixed to said stationary frame, a second member which is located adjacent to said first member and which has a bore formed therethrough which non-rotatably receives said torque limiter shaft, and means for preventing rotation of said second member relative to said first member unless a torque imposed on said second member by said torque limiter shaft exceeds a designated threshold.

6. A crusher as defined in claim 5, wherein said means for preventing comprises 1) a slide plate which selectively meshes with said second member, 2) a ball and ramp assembly disposed between said first member and said slide plate and 3) a belleville washer assembly which biases said slide plate towards said first member.

7. A crusher as defined in claim 5, wherein said clutch is a two-way clutch.

8. A crusher as defined in claim 1, wherein said gear train comprises a first gear which is located above an upper surface of said main drive gear and which is fixed to said lower portion of said eccentric shaft, an idler shaft which is rotatably journaled in said main drive gear at a location offset from said vertical axis, said idler shaft having an upper end located above said upper surface of said main drive gear and a lower end located below a lower surface of said main drive gear, a second gear which is fixedly mounted on said upper end of said idler shaft and which meshes with said first gear, said first and second gears having a gear ratio of 1:1, a third gear which is fixedly mounted on said lower end of said idler shaft, a torque limiter shaft which is affixed to said torque limiter and which has an upper end located above said torque limiter, and a fourth gear which is affixed to said upper end of said torque limiter shaft and which meshes with said third gear, said third and fourth gears having a gear ratio of 1:1.

9. A gyratory crusher comprising:

(A) a stationary frame;

(B) a bevel gear which is mounted on said frame and which is driven to rotate about a vertical axis;

(C) an eccentric shaft which is rotatably supported on said bevel gear and which is rotatable about an axis which is offset from and inclined with respect to said vertical axis, said eccentric shaft having an upper portion terminating in an upper end and having a lower portion;

(D) a crushing head fixedly mounted on said upper end of said eccentric shaft; and (E) an anti-spin mechanism comprising (1) a torque limiter located in the vicinity of said lower portion of said eccentric shaft, said torque limiter comprising a two-way clutch including (a) a stationary ring which is fixed to said stationary frame and which has an aperture formed therethrough, (b) an externally toothed hub which extends through said aperture in said stationary ring and which has a bore formed therethrough, (c) an internally toothed slide plate which selectively meshes with said hub, (d) a ball and ramp assembly disposed between said slide plate and said stationary ring, and (e) a belleville washer assembly which biases said slide plate towards said ring, (2) a gear train operatively coupled to said lower portion of said eccentric shaft and to said torque limiter, said gear train including (a) a first gear which is located above an upper surface of said bevel gear and which is fixed to said lower portion of said eccentric shaft, (b) an idler shaft which is rotatably journaled in said bevel gear at a location offset from said vertical axis, said idler shaft having an upper end located above said upper surface of said bevel gear and a lower end located below a lower surface of said bevel gear, (c) a second gear which is fixedly mounted on said upper end of said idler shaft and which meshes with said first gear, said first and second gears having a gear ratio of 1:1, (d) a third gear which is fixedly mounted on said lower end of said idler shaft, (e) a torque limiter shaft which has upper and lower ends, said lower end of said torque limiter shaft being non-rotatably received in said bore in hub, and (f) a fourth gear which is affixed to said upper end of said torque limiter shaft and which meshes with said third gear, said third and fourth gears having a gear ratio of 1:1.

* * * * *